US007731786B2

(12) United States Patent
Dupuis et al.

(10) Patent No.: US 7,731,786 B2
(45) Date of Patent: Jun. 8, 2010

(54) PHOTOSENSITIVE DISPERSION WITH ADJUSTABLE VISCOSITY FOR THE DEPOSITION OF METAL ON AN INSULATING SUBSTRATE AND USE THEREOF

(75) Inventors: Olivier Dupuis, Hevillers (BE); Mary-Helene Delvaux, Hevillers (BE)

(73) Assignee: Semika, Luxembourg (LU)

( * ) Notice: Subject to any disclaimer, the term of this patent is extended or adjusted under 35 U.S.C. 154(b) by 0 days.

(21) Appl. No.: 12/222,965

(22) Filed: Aug. 20, 2008

(65) Prior Publication Data

US 2009/0017221 A1 Jan. 15, 2009

Related U.S. Application Data

(63) Continuation of application No. 10/541,210, filed on Jun. 30, 2005, now abandoned.

(51) Int. Cl.

| | |
|---|---|
| ***C23C 18/44*** | (2006.01) |
| ***C23C 18/28*** | (2006.01) |
| ***C23C 16/40*** | (2006.01) |
| ***B32B 27/28*** | (2006.01) |
| ***C08K 3/10*** | (2006.01) |

(52) U.S. Cl. ..... 106/1.28; 106/1.25; 106/1.11; 524/300; 524/403

(58) Field of Classification Search ..... 106/1.11, 106/194.1, 195.1, 198.1, 1.25, 1.28; 524/300, 524/403

See application file for complete search history.

(56) References Cited

U.S. PATENT DOCUMENTS

| | | | | |
|---|---|---|---|---|
| 3,719,490 | A * | 3/1973 | Yudelson et al. | 430/202 |
| 3,950,290 | A | 4/1976 | Drury et al. | |
| 4,622,069 | A * | 11/1986 | Akai et al. | 106/1.11 |
| 5,075,039 | A * | 12/1991 | Goldberg | 252/519.34 |
| 5,264,466 | A * | 11/1993 | Takiyama et al. | 523/122 |
| 5,356,956 | A | 10/1994 | Uemae et al. | |
| 5,685,898 | A * | 11/1997 | Dupuis et al. | 106/1.11 |
| 5,830,927 | A | 11/1998 | Vanderhoff et al. | |
| 6,291,025 | B1 | 9/2001 | Tepper et al. | |
| 2004/0037978 | A1 * | 2/2004 | Tsubaki et al. | 428/32.26 |

FOREIGN PATENT DOCUMENTS

| | | |
|---|---|---|
| JP | 60-155678 | 8/1985 |
| JP | 62-109393 | 5/1987 |
| JP | 2-205388 | 8/1990 |
| JP | 200297577 | 4/2002 |
| JP | 2002317274 | 10/2002 |
| WO | 0138603 | 5/2001 |

OTHER PUBLICATIONS

English Abstract of JP02-205388.
English Abstract of JP62-109393.
English Abstract of JP60-155678.
English Abstract of JP2003-295329.

* cited by examiner

*Primary Examiner*—Jerry Lorengo
*Assistant Examiner*—Shuangyi Abu Ali
(74) *Attorney, Agent, or Firm*—Dykema Gossett PLLC

(57) ABSTRACT

The invention relates to a photosensitive dispersion with adjustable viscosity for metal deposition on an insulating substrate, which combines the following: a pigment providing oxidation-reduction properties under light irradiation, a metallic salt, a complex-forming agent for the metallic salt, a liquid film-forming polymer formulation, a basic compound, an organic solvent and water. The invention also relates to the use of said dispersion.

27 Claims, No Drawings

PHOTOSENSITIVE DISPERSION WITH ADJUSTABLE VISCOSITY FOR THE DEPOSITION OF METAL ON AN INSULATING SUBSTRATE AND USE THEREOF

BACKGROUND OF THE INVENTION

1. Field of the Invention

The present invention relates to a photosensitive dispersion with adjustable viscosity for depositing metal on an insulating substrate and use thereof.

2. The Prior Art

The patent EP 0 687 311 of the applicant concerns a polymeric resin with adjustable viscosity and pH for depositing catalytic palladium on a substrate, comprising, in combination, a palladium salt, a sequestering agent of the chloride or carboxylic acid type, a polymer containing hydroxyl and/or carboxyl groups soluble in water, a basic compound and a solvent chosen from amongst water, methanol and ethanol, the pH value being between 1 and 10, and to its applications for the deposition of catalytic palladium on the substrate surface and for the metallisation of these surfaces. Although this type of polymeric resin with palladium has proved advantageous in a large number of applications in the metallisation of polymeric substrates and the like, in particular because of its stability over time and the adjustability of its viscosity and pH, it does however have a certain number of drawbacks, including the obligatory use of palladium, which is a noble metal that is both expensive and whose price fluctuates greatly on the market, and the obligatory passage through an autocatalytic (electroless) bath for the metallisation of the non-conductive substrate and also because of the fact that the photosensitivity of the resin is reduced to a narrow range of wavelengths lying between 190 and 300 nm, thus greatly limiting the type of application that can be envisaged and the radiation source that can be used in this regard.

One of the essential aims of the present invention consequently consists of remedying the aforementioned drawbacks and presenting a photosensitive dispersion with adjustable viscosity that no longer necessarily requires the use of a noble metal such as palladium and also having recourse to other more common and less expensive metals and whose photosensitivity is broadened to a range of wavelengths between 190 and 450 nm requiring much lower irradiation energy than the polymer resins known up till now, below 100 mJ/cm2, and not requiring the obligatory passage through an autocatalytic bath for metallising the substrate, consequently allowing direct electrolytic metallisation.

SUMMARY OF THE INVENTION

To this end, according to the invention, the photosensitive dispersion comprises, in combination, a pigment conferring properties of oxidation-reduction under light irradiation, a metallic salt, a sequestering agent for the metallic salt, a liquid film-forming polymeric formulation, a basic compound, an organic solvent and water.

According to one advantageous embodiment of the invention, the pigment is titanium dioxide and is in the form of a fine powder.

According to another advantageous embodiment, the metallic salt is a transition metallic salt and in particular chosen from the group comprising copper, gold, platinum, palladium, nickel, cobalt, silver, iron, zinc, cadmium, ruthenium and rhodium, and is preferably copper (II) chloride, copper (II) sulphate, palladium (II) chloride, nickel (II) chloride or a mixture of at least two of these salts.

According to yet another advantageous embodiment of the invention, the liquid film-forming polymeric formulation is in the form of a solution or emulsion, and in particular a solution of the alkyl, acrylic, polyester or epoxy type, an acrylic emulsion or a mixture of these.

The present invention also concerns a method of depositing metal on the surface on an insulating substrate, by means of a photosensitive dispersion, which consists of applying the said dispersion in the form of a film to the substrate in a selective manner or not, drying the film applied to the said substrate and irradiating by means of an ultraviolet and/or laser radiation with a range of wavelengths lying between 190 and 450 nm and an energy of between 25 mJ/cm2 and 100 mJ/cm2 until a layer of metal, selective or not, is obtained on the substrate.

Other details and particularities of the invention will emerge from the following description, by way of non-limiting example, of photosensitive dispersions according to the invention and their applications for the deposition of metal on the insulating substrate surface as well as for the metallisation of these surfaces.

As already stated previously, the aim of these photosensitive dispersions with variable viscosity of the invention is to replace the polymeric resins and solutions with palladium known up to the present time, the main drawbacks of which have been stated, and developing photosensitive dispersions with adjustable viscosity and a much more extensive applicability than the known resins, comprising, in combination, a pigment conferring oxidation-reduction properties under light irradiation, a metallic salt, a sequestering agent for the metallic salt, a liquid film-forming polymeric formulation, a basic compound, an organic solvent and water.

The expression "pigment conferring properties of oxidation-reduction under light irradiation" means any pigment capable of forming on the surface an oxidising-reducing system under light irradiation. In fact, a particle of pigment is a semiconductor and when this is subjected to a chosen radiation the energy of this radiation will allow the formation of an oxidising-reducing pigment particle. Thus the particle formed in this way will be able to effect the following two reactions simultaneously, namely the reduction of a cationic species adsorbed on the surface and the oxidation of an ionic species adsorbed on the surface. These pigments are used in the form of finely divided powders, generally with a particle size ranging from 10 nanometres to 10 micrometres, advantageously with a particle size of 15 nanometres to 1 micrometre. Titanium dioxide is the pigment best suited for this purpose.

The metal of the metallic salt is advantageously a transition metal, and is more particularly copper, gold, platinum, palladium, nickel, cobalt, silver, iron, zinc, cadmium, ruthenium or rhodium or a mixture of at least two of these. Particularly advantageous metallic salts are copper (II) chloride, copper (II) sulphate, palladium (II) chloride, nickel (II) chloride and mixtures of at least two of these salts.

According to the invention, the expression "liquid film-forming polymeric formulation" means that the polymer is in the form of a solution or emulsion or any similar composition and in fact serves as an agent for adjusting the viscosity of the photosensitive dispersion so as to obtain in this way a continuous homogeneous film on the surface of the substrate by means of various coating means such as spraying, dipping, roller application, screen printing, pad printing or the like. In addition, this polymer also participates in the oxidation-reduction reaction. In fact, the pigment made semiconducting under the light irradiation reduces the metallic cations of the metallic salt but, for this reaction to be effective, the pigment must also oxidise another compound, a role which is held in the present case by a solid film from which all the solvents were evaporated during drying after coating. Consequently the pigment on the one hand reduces the metallic cations but on the other hand oxidises the substrate, for the pigment particles which are in contact with it, thus ensuring good adhesion, as well as the film-forming polymeric matrix for the particles which are not in contact with the substrate, thus ensuring good efficacy of the reaction as a "solid" film. Examples of formulations are the film-forming polymeric solutions of the alkyl, acrylic, polyester and epoxy type, and acrylic emulsions such as those normally used in the preparation of alkalis, detergents, paints and inks, and mixtures of these solutions and/or emulsions.

The sequestering agent for a metallic salt is advantageously of the sulphate, chloride or carboxylic acid type. The purpose of this sequestering agent, by coordinating itself with the metallic salt, is to solubilise the latter. Examples of sequestering agents of the carboxylic acid type are tartaric acid, citric acid, derivatives thereof and mixtures of at least two of these compounds.

The basic compound used in the context of the photosensitive dispersion serves to neutralise all the acids present in it and to adjust the pH beyond 7. Potassium hydroxide, sodium hydroxide, ammonia and mixtures thereof are examples of bases that can be used. The use of a basic salt such as sodium carbonate, potassium carbonate, calcium carbonate and mixtures thereof could also be envisaged. Mixtures of a base and a basic salt can also be envisaged.

The organic solvent and the water have an important role to play in the context of the photosensitive dispersion of the invention. The organic solvent will be chosen from amongst ethers, esters, ketones and alcohols, alone or in a mixture. The role of the organic solvents is manifold. They ensure in particular good adhesion of the film to the insulating substrate and thus good attachment of the pigment to the substrate, good formation of the films, rapid drying or again good dispersion of these various components in the catalytic paint. The solvents are advantageously used in a mixture so as to apportion the property relating to each one vis-à-vis their respective role in the product, for the formation of the film or on the substrate. Examples of solvents used in isolation or in a mixture are dioxane, cyclohexanone, 2-methoxy-1-methylethyl acetate, mixtures of dipropylene glycol methyl ether isomers, mixtures of tripropylene glycol methyl ether isomers, and mixtures of at least two of these. The water is advantageously deionised water. The presence of the water in a fairly small quantity is also important. This is because this makes the photosensitive dispersion less corrosive than the majority of formulations of the prior art and affords ease of application in all circumstances through its formulation close to a paint. The presence of an organic solvent or solvents also makes it possible to avoid chemical and/or mechanical pretreatment of the surface of the substrate and better control over the evaporation temperature than in a case of aqueous solutions containing a much greater proportion of water.

As additions compatible with the photographic dispersion of the invention, there will advantageously be added, as already stated above, one or more mixtures of wetting and/or dispersing agents. The wetting agent is an agent modifying the surface tension and its purpose is to reduce this by forming an adsorbed layer having a surface tension intermediate between the liquid/liquid or liquid/solid phases. Advantageous wetting agents are silanes, fluoroaliphatic polymer esters or products with a high percentage of 2-butoxyethanol. Typical commercial products are Dapro U99 manufactured by Daniel Products and Schwego-wett (registered trade marks). The dispersing agent is advantageously a dispersing agent for pigments compatible with acrylic polymers, polyesters and epoxides. It improves the dispersion of the solid pigment particles which may be present in the catalytic paint. Examples of dispersing agents are Disperse-AYD W-33 (a mixture of non-ionic and anionic surface-active agents in solution in water) and Deuteron ND 953 (an aqueous solution of sodium polyaldehydocarbonate) (registered trade marks), respectively manufactured by Elementis and Deuteron.

With regard to the concentrations of the various components of the photosensitive dispersion or catalytic paint of the invention, these will of course depend on the nature of these components and of the solvent used. However, use will be made in general terms, according to the invention, of the pigment and more particularly the titanium dioxide in a concentration, as a percentage by weight, of 1% to 50% and preferably 5% to 25%, the metallic salt in a concentration, as a percentage by weight, of 0.01% to 5% and preferably 0.05% to 1%, the sequestering agent in a concentration, in a percentage by weight, of 0.01% to 10% and preferably 0.1% to 1%, the film-forming polymeric emulsion and/or solution in a concentration, as a percentage by weight, of 1% to 50% and preferably 5% to 25%, the base in a concentration, as a percentage by weight, of 0.01% to 5% and preferably 0.1% to 1%, the organic solvent in a concentration, as a percentage by weight, of 0.1% to 55% and preferably 1% to 40% and the water in a concentration, as a percentage by weight, of 1% to 15%. The concentration of wetting agent, as a percentage by weight, is 0.1% to 5% and preferably 0.25% to 1.0%, and the concentration of dispersing agent, as a percentage by weight, is 0.1% to 15% and preferably 0.2% to 2%.

The preparation of the photosensitive dispersions of the invention is carried out according to a simple process of mixing all the various constituents which it contains. The order of addition of each of these constituents is of no importance and has no consequence on the intrinsic properties of the dispersion. In fact, all the components constituting the photosensitive dispersion, namely the pigment, the metallic salt, the sequestering agent, the liquid film-forming polymeric formulation, the basic compound, the organic solvent and the water as well as any additions are mixed and the said dispersion is applied in the form of a film to the substrate selectively rather than according to the application envisaged. Next the film applied to the substrate is dried and is irradiated by means of an ultraviolet and/or laser radiation with a range of wavelengths of between 190 and 450 nm and an energy of between 25 mJ.cm2 and 100 mJ/cm2 until a layer of metal, selective or not, is obtained on the substrate.

Examples of photosensitive dispersions of the invention are given below, as well as techniques for their use.

EXAMPLE 1

Catalytic paint with palladium for the metallisation, selective or not, of a polymeric substrate.

| Composition of the dispersion | Concentration as % by weight |
|---|---|
| Titanium dioxide as finely divided powder | 5 to 25 |
| Dioxane | 10 to 30 |
| 2-methoxy-1-methylethyl acetate | 25 to 40 |
| Mixture of dipropylene glycol methyl ether isomers | 1 to 15 |

-continued

| Composition of the dispersion | Concentration as % by weight |
|---|---|
| Disperse-AYD ® W33 1) | 0.2 to 2 |
| Joncryl ® 537 2) | 5 to 25 |
| Mixture of tripropylene glycol methyl ether isomers | 1 to 5 |
| Dapro ® U99 3) | 0.25 to 1 |
| Palladium (II) chloride (metallic salt) | 0.05 to 1 |
| Tartaric acid (sequestering agent) | 0.1 to 1 |
| Ammonia (base) | 0.1 to 1 |
| Deionised water | 1 to 15 |

1) Dispersing agent manufactured by Elementis: mixture of non-ionic and anionic surface-active agents in water.

2) Film-forming acrylic polymeric emulsion, manufactured by Johnson Polymer, registered trade mark.

3) Wetting agent manufactured by Daniel Products: silicon-free interface tension modifier.

The catalytic dispersion or paint is applied to a polymer substrate, without any prior treatment of the latter, by dipping, spraying, roller application or pad printing, and is then dried in air for a few seconds. The film thus obtained is irradiated using commonly used UV lamps and/or laser and having a spectrum of between 250 and 450 nm, for the time necessary for the film to receive a minimum energy of 25 mJ/cm2. If selective metallisation is required, this irradiation will be performed through a mask. The result is the deposition of a catalytic palladium layer, selective or not. In the case of selective metallisation, the non-irradiated parts are solubilised in water. A metallic overloading by electroplating is then made possible, the substrate being made conductive.

EXAMPLE 2

Catalytic paint with copper for the metallisation, selective or not, of a polymer substrate.

| Composition of the dispersion | Concentration as % by weight |
|---|---|
| Titanium dioxide as finely divided powder | 5 to 25 |
| Dioxane | 10 to 30 |
| 2-methoxy-1-methylethyl acetate | 25 to 40 |
| Mixture of dipropylene glycol methyl ether isomers | 1 to 15 |
| Disperse-AYD ® W33 1) | 0.2 to 2 |
| Joncryl ® 537 2) | 5 to 25 |
| Mixture of tripropylene glycol methyl ether isomers | 1 to 5 |
| Dapro ® U99 3) | 0.25 to 1 |
| Copper (II) chloride (metallic salt) | 0.05 to 1 |
| Citric acid (sequestering agent) | 0.1 to 1 |
| Ammonia (base) | 0.1 to 1 |
| Deionised water | 1 to 15 |

1) Dispersing agent manufactured by Elementis: mixture of non-ionic and anionic surface-active agents in water.

2) Film-forming acrylic polymeric emulsion, manufactured by Johnson Polymer, registered trade mark.

3) Wetting agent manufactured by Daniel Products: silicon-free interface tension modifier.

The same procedure as in Example 1 is followed. The result is the deposition of a catalytic copper layer, selective or not. In the case of a selective metallisation, the non-irradiated parts are solubilised in water. A metallic overloading by electroplating is then made possible.

In fact the metallic salt could be replaced in the concentrations indicated by all the specifically cited salts, namely copper (II) sulphate and palladium and nickel (II) chlorides.

The substrates tested in the context of the aforementioned examples are normal plastics materials such as ABS, ABS-PC (polycarbonate), certain polyamides, epoxy materials, polycarbonates and the like.

Apart from the advantages clearly defined of the photosensitive dispersion of the invention compared with the polymeric resins or other formulations known, it should be noted that the dispersion is a formulation extremely close to a paint, making it easy to apply in all circumstances. In addition, apart from the fact that it is no longer necessary to have recourse to chemical and/or mechanical pretreatment of the insulating substrate so as to obtain good adhesion of the final metallic deposition through controlled selective oxidation of the surface of the substrate by the pigment, the photosensitive catalytic paint or dispersion of the invention presents no corrosiveness, unlike the formulations of the prior art, which are all very corrosive.

Naturally the present invention is in no way limited to the embodiments described above and many modifications can be made without departing from the scope of the present patent.

The invention claimed is:

1. A method of depositing metal on the surface of an insulating substrate, comprising the steps of:

(1) applying a dispersion comprising a titanium dioxide conferring properties of oxidation-reduction under light irradiation, a metallic salt supplying metal cation, a sequestering agent for the metallic salt, a liquid film-forming polymeric formulation, a basic compound, an organic solvent and water onto a substrate in the form of a film, (2) drying the polymeric film applied to the substrate by evaporating said organic solvent, (3) irradiating the polymeric film and the substrate by means of ultraviolet radiation and/or laser with a range of wavelengths between 190 and 450 nm and an energy between 25 mJ/cm$^2$ and 100 mJ/cm$^2$ and forming a semi conductor titanium dioxide, (4) oxidizing the film and the substrate by the semiconductor titanium dioxide thereby formed together with reducing a metallic cation of the said metallic salt, and (5) forming a layer of metal on the substrate.

2. The method according to claim 1, wherein step (3) is performed through a mask.

3. The method according to claim 1, wherein titanium dioxide is contained in the dispersion in a concentration sufficient to reduce said metallic cations of said metallic salt and oxidizing the substrate as well as the film-forming polymeric formulation during step (3).

4. The method according to claim 1, wherein the metallic salt is a transition metal salt.

5. The method according to claim 4, wherein the transition metal is selected from the group consisting of copper, gold, platinum, palladium, nickel, cobalt, silver, iron, zinc, cadmium, ruthenium and rhodium.

6. The method according to claim 5, wherein the transition metal salt is selected from the group consisting of copper (II) chloride, copper (II) sulphate, palladium (II) chloride, nickel (II) chloride and mixtures of at least two thereof.

7. The method according to claim 1, wherein the sequestering agent for the metallic salt is of the sulphate, chloride or carboxylic acid type.

8. The method according to claim 7, wherein the sequestering agent of the carboxylic acid type is tartaric acid, citric acid, a derivative of these or a mixture thereof.

9. The method according to claim 1, wherein the liquid film-forming polymeric formulation is a solution or emulsion.

10. The method according to claim 9, wherein the liquid film-forming polymeric formulation is a solution of the alkyl, acryl, polyester or epoxy type, an acrylic emulsion or a mixture thereof.

11. The method according to claim 1, wherein the basic compound is a base, a basic salt or a mixture thereof.

12. The method according to claim 11, wherein the basic compound is a base selected from the group consisting of potassium hydroxide, sodium hydroxide and ammonia.

13. The method according to claim 1, wherein the organic solvent is selected from the group consisting of ethers, esters, ketones, alcohols and mixtures thereof.

14. The method according to claim 13, wherein the organic solvent is selected from the group consisting of dioxane, cyclohexanone, 2-methoxy-1-methylethyl acetate, a mixture of dipropylene glycol methyl ether isomers, a mixture of tripropylene glycol methyl ether isomers and mixtures of at least two thereof.

15. The method according to claim 1, wherein water is deionized water.

16. The method according to claim 1, wherein the dispersion further comprises at least one wetting agent, a dispersing agent or a mixture thereof.

17. The method according to claim 1, wherein the concentration of metallic salt, as a percentage by weight, is 0.01% to 5%.

18. The method according to claim 1, wherein the concentration of sequestering agent, as a percentage by weight, is 0.01% to 10%.

19. The method according to claim 1, wherein the concentration of film-forming polymeric formulation, as a percentage by weight, is 1% to 50%.

20. The method according to claim 1, wherein the concentration of base, as a percentage by weight, is 0.01% to 5%.

21. The method according to claim 1, wherein the concentration or organic solvent, as a percentage by weight, is 0.1% to 55%.

22. The method according to claim 1, wherein the concentration of water, as a percentage by weight, is 1% to 15%.

23. The method according to claim 1, wherein said transition metal salt is copper (ii) chloride.

24. The method according to claim 1, wherein said liquid film-forming polymeric formulation consists of alkyl compounds.

25. The method according to claim 1, wherein said liquid film-forming polymeric formulation consists of polyester compounds.

26. The method according to claim 1, wherein said liquid film-forming polymeric formulation consists of epoxy compounds.

27. The method according to claim 1, wherein the dispersion is prepared in a single step of mixing all the various constituents which it contains.

* * * * *